US005165434A

United States Patent [19]

Tobiason

[11] Patent Number: 5,165,434

[45] Date of Patent: Nov. 24, 1992

[54] APPARATUS FOR APPLYING DRY HERBICIDES TO FLORA INFESTATIONS WITHIN SEWER LINES

[75] Inventor: Timothy W. Tobiason, Silver Creek, Nebr.

[73] Assignee: Toby's Chemical Co., Silver Creek, Nebr.

[21] Appl. No.: 740,346

[22] Filed: Aug. 5, 1991

[51] Int. Cl.[5] ..... B08B 9/04

[52] U.S. Cl. ..... 134/113; 134/168 C; 239/DIG. 13

[58] Field of Search ..... 134/113, 167 C, 168 C; 71/DIG. 1, 65; 239/DIG. 13, 346

[56] References Cited

U.S. PATENT DOCUMENTS

| | | | |
|---|---|---|---|
| 2,763,288 | 9/1956 | Tharp | 134/168 C X |
| 3,635,230 | 1/1972 | Kirschke | 134/168 C |
| 3,655,122 | 4/1972 | Brown et al. | 134/167 C X |
| 3,880,176 | 4/1975 | Horne | 134/167 C |
| 4,781,329 | 11/1988 | Tenney et al. | 239/346 X |
| 4,944,320 | 7/1990 | Waite et al. | 134/168 C X |
| 5,018,545 | 5/1991 | Wells | 134/167 C X |
| 5,020,188 | 6/1991 | Walton | 134/167 C X |

*Primary Examiner*—Philip R. Coe
*Attorney, Agent, or Firm*—Henderson & Sturm

[57] ABSTRACT

An apparatus for applying dry herbicides to sewer lines which includes a container for storing a herbicide, a length of tubing, and nozzle means connected to the tubing. Also included are means for propelling herbicide stored in the container through the tubing such that herbicide may be dispersed from the nozzle. Locomotion means are also provided for transporting the nozzle within the interior of a sewer line such that the interior surfaces of a sewer line may be sprayed with a herbicide. In this fashion herbicide may be directed at any flora growing within the sewer line.

5 Claims, 4 Drawing Sheets

APPARATUS FOR APPLYING DRY HERBICIDES TO FLORA INFESTATIONS WITHIN SEWER LINES

BACKGROUND OF THE INVENTION

1. Technical Field

The present invention is directed to herbicide applicators, and more particularly to devices adapted to apply herbicides within the interior of sewer lines.

2. Description of the Prior Art

Sewer lines are prone to developing leaks. This is especially true of lines running from buildings adjacent to high traffic roadways, areas where earthquakes are common, and where settling occurs around sewer line joints.

The openings that develop are often penetrated by roots. In time, these roots can clog or rupture a sewer line. Once a clog or rupture occurs, the sewer line must be removed and replaced. This replacement procedure is expensive and typically results in the loss of surrounding flora.

In order to prevent flora damage to sewer lines various herbicides have been used. The most common of these has been copper(II) sulfate. The prior art teaches flushing herbicide through sewer lines infested with flora.

Several herbicides are known which deter the growth of roots. However, the herbicidal application techniques known to the art are haphazard and expensive. For example, there is no practical method of determining how much, if any, of the herbicide has reached potentially damaging root growths. Herbicide applications are expensive, and over application may lead to the death of the flora.

Additionally, water is a poor carrying agent in sewer lines since it will not allow the entire line to be flushed with a herbicide, clearing only a free path along the normal fluid flow lines.

Also known to the art are chemically foaming mixtures which produce foam in the presence of sewer water in order to carry a herbicide throughout the interior of sewer lines.

In large industrial and/or urban sewer systems, it has been known to introduce a detergent and air from a hose connected to a high pressure air source so as to produce a herbicidal carrying agent. However, although such an application method has been proven effective, it requires a large amount of herbicide which makes such a method expensive and potentially damaging to the environment.

3. Objects of the Invention

Therefore, it is a principal object of the present invention to provide an economical and environmentally sound method and apparatus for applying herbicides to flora infestations within sewer lines.

Another object of the present invention is to provide an apparatus capable of applying herbicides directly to flora infestations within a sewer lines.

Another object of the present invention is to provide an apparatus for applying herbicides to flora infestations within sewer lines which is safe and easy to use.

Another object of the present invention is to provide an apparatus for applying herbicides to the interior of sewer lines which is economical to manufacture and durable in use.

Finally, another object of the present invention is to provide a method of applying herbicides to flora infestations which does not unnecessarily damage the flora, environment, or sewer lines. These and other objects will be apparent to those skilled in the art.

SUMMARY OF THE INVENTION

The present invention discloses an apparatus for applying dry herbicides to sewer line interiors. The apparatus includes a container for storing a herbicide, a length of tubing, and nozzle means connected to the tubing. Also included are means for propelling herbicide stored in the container through the tubing such that herbicide may be dispersed from the nozzle.

Locomotion means are also provided for transporting the nozzle within the interior of a sewer line such that the interior surfaces of a sewer line may be sprayed with a herbicide. In this fashion herbicide may be directed at any flora growing within the sewer line.

The apparatus may also include further refining features. For example, control means may also be provided for aiming the nozzle such that the direction of dispersal of herbicides from the nozzle is operably controlled. Application rate means may also be provided for controlling the amount of herbicide dispersed from the nozzle. Likewise, locomotion control means may be provided for controlling the velocity and direction of the locomotion means within the interior of a sewer line. Additionally, video means may be supplied for providing real time images of sewer line herbicide applications.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1:
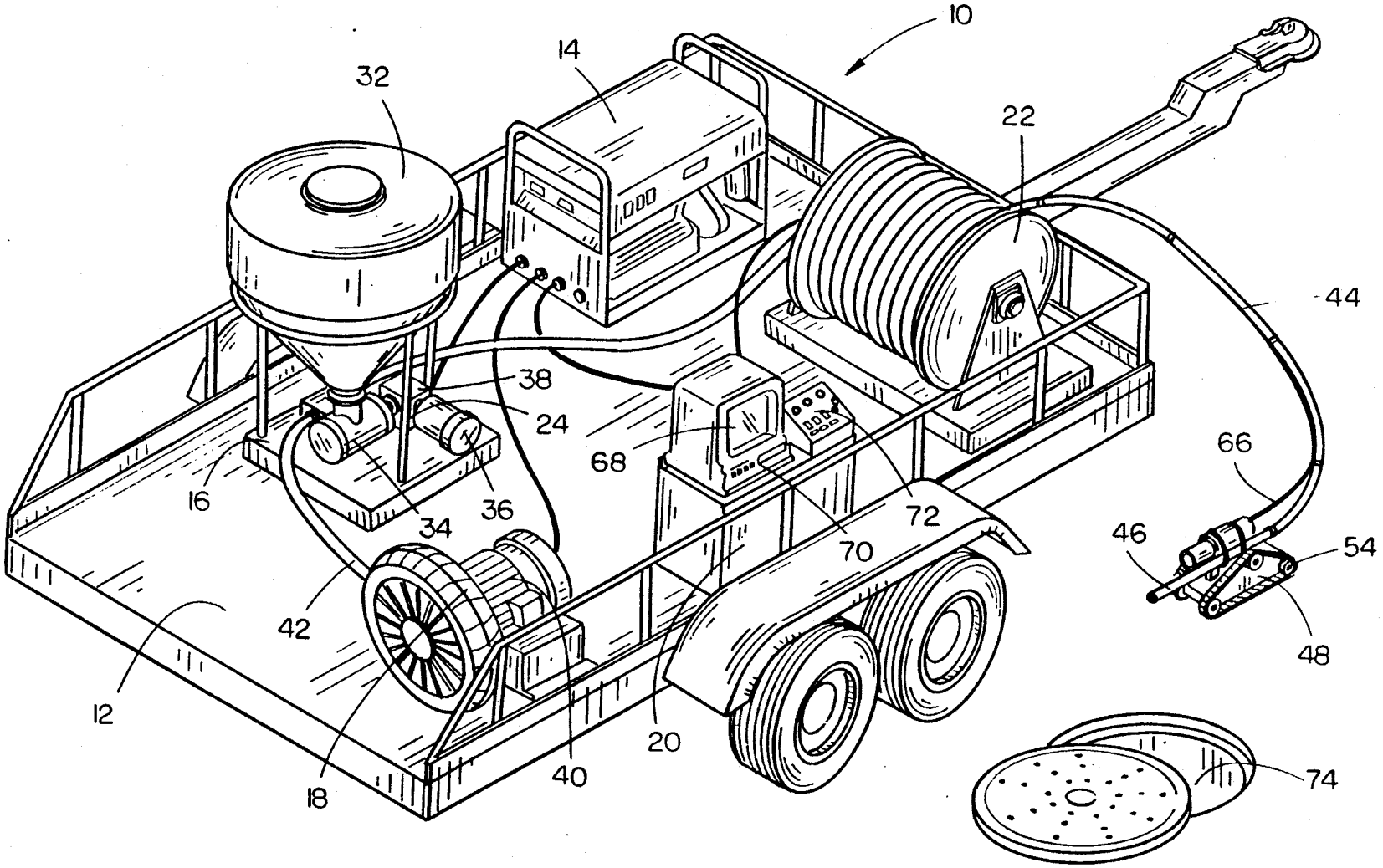
FIG. 1 is a perspective view of a preferred embodiment of the apparatus for applying dry herbicides to sewer lines showing the major components of the present invention mounted on a trailer.

A preferred embodiment of the present invention 10 is illustrated in FIGS. 1 through 4. The described embodiment of the apparatus of the invention may be used to practice the method of the invention. Turning to the figures, wherein like reference numerals refer to like components, FIG. 1 illustrates the major assemblies and components of the invention 10.

For ease in transporting the apparatus 10 to job sites a towable trailer 12 is provided. Mounted on the trailer is an electric generator 14, dry herbicide hopper assembly 16, ring compressor 18, video and control assembly 20, and a hose and reel assembly 22.

The electric generator 14 provides electric current to a rotary airlock and drive 24 and ring compressor motor 40 such that herbicide within the hopper 32 is fed into the hose 40. In a preferred embodiment the electric generator 14 is a 3-phase 4000 watt generator with one 14 amp 3-phase receptacle, one single phase 30 amp receptacle, and two 120 volt 20 amp receptacles. The Grainger model 4W111 is used in the preferred embodiment.

A plastic dry herbicide hopper 32 feeds into a rotary airlock 34 which is rotatably operated by an electric motor 36 and gearbox 38. Rotary airlocks are available from Schick Tube Veyer, 4346 Clary Blvd., Kansas City, Mo. Electric current from the electric generator 14 also powers the ring compressor motor 40 forcing air through a blower hose 42 such that herbicide is forced into the tubing 44 (FIG. 1). In a preferred embodiment, the tubing 44 is stored on the hose and reel assembly 22. The tubing 44 is stored on the hose and reel assembly 22. The tubing 44 is preferably 300 to 500 feet in length.

Figure 3:
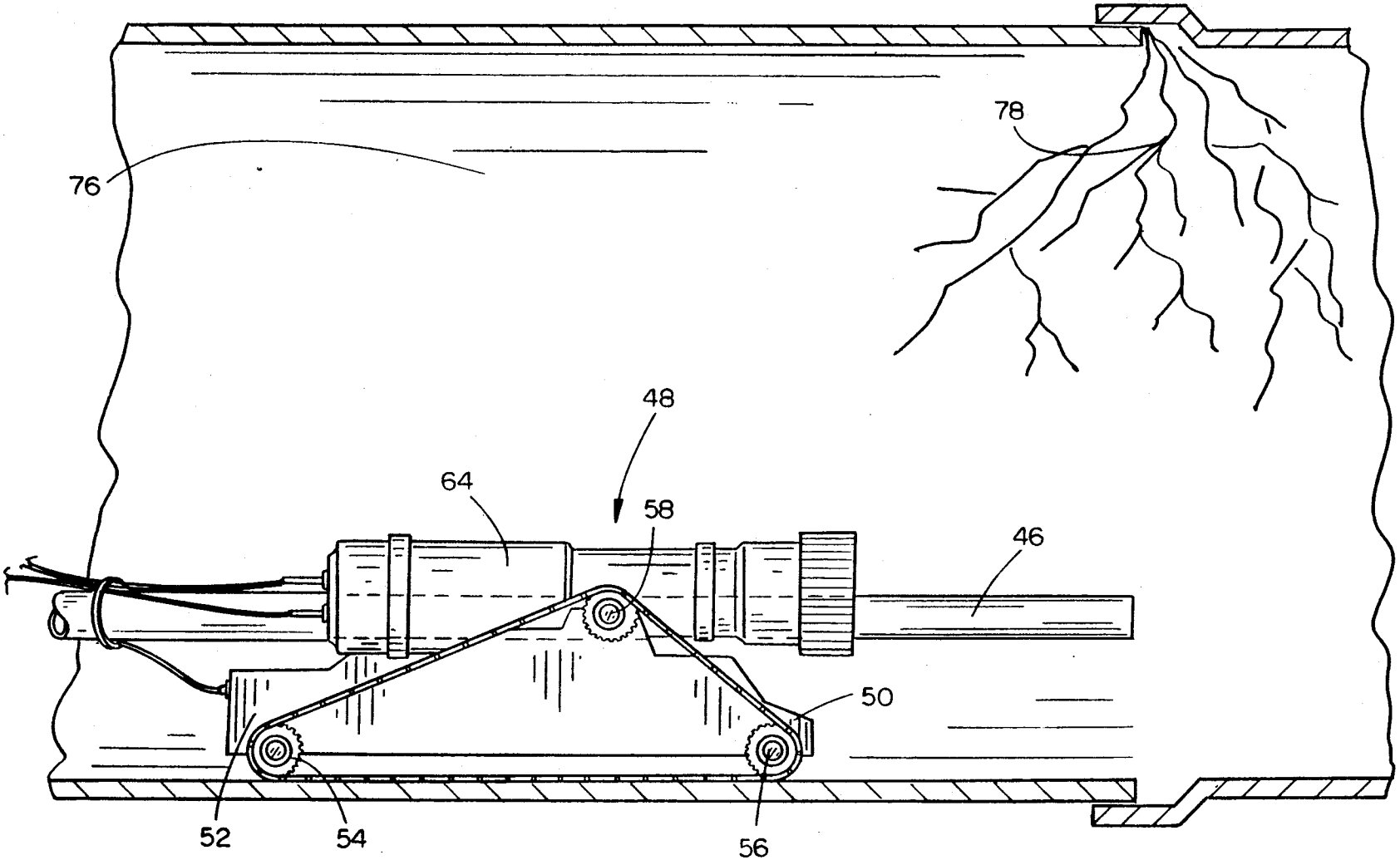
FIG. 3 is a side elevational view of a preferred embodiment of the locomotion means of the present invention showing a video camera and herbicide nozzle controllably mounted to the locomotion means.
Figure 4:
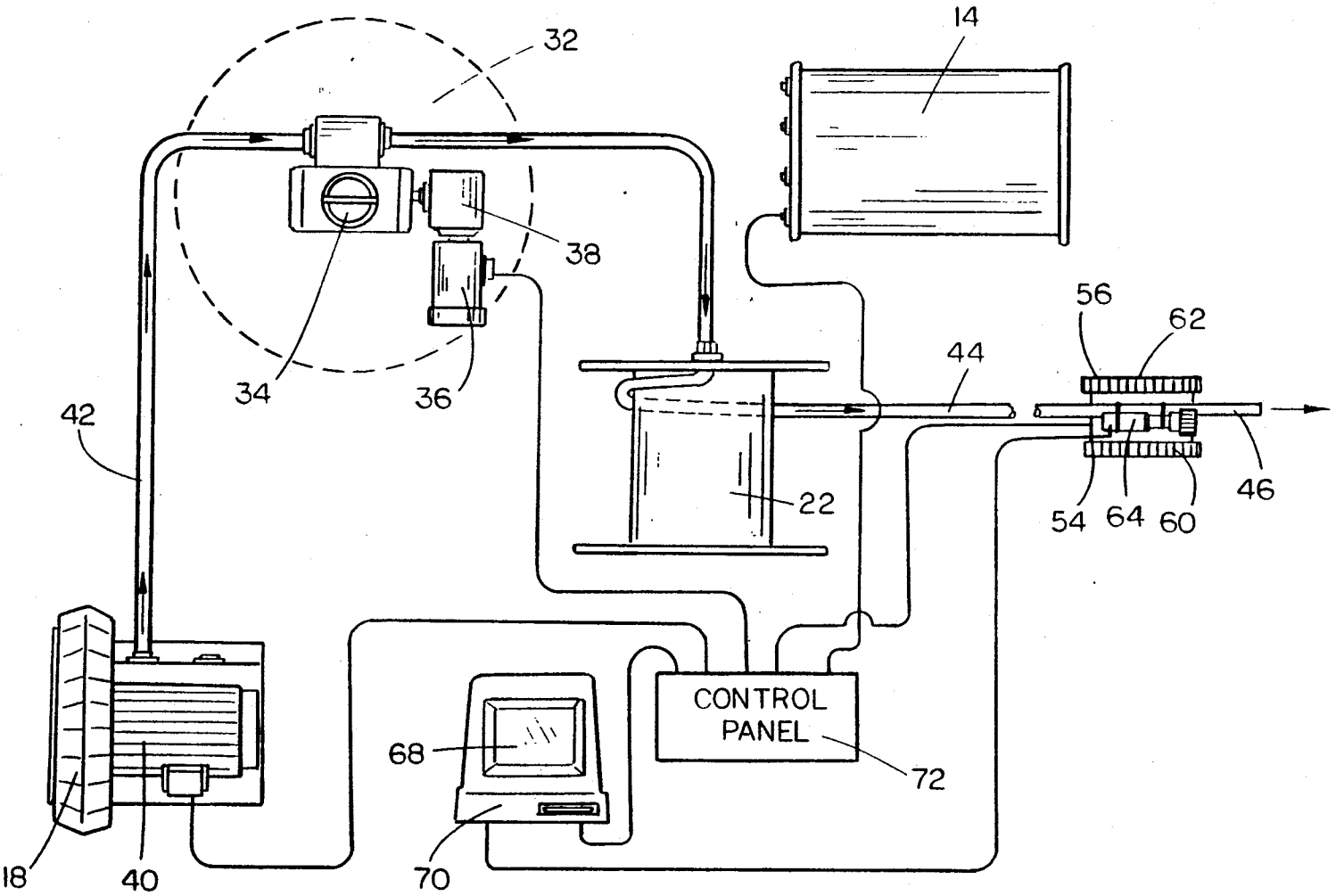
FIG. 4 is a largely diagrammatic top plan view of the major components of a preferred embodiment of the apparatus for applying dry herbicides to sewer lines.

The tubing 44 is connected to a nozzle 46 mounted on a tractor assembly 48 (FIG. 3). The tractor assembly 48 includes a water tight housing 50. A reversible motor 52 is mounted within the housing 50 which drives a pair of opposing gears (54, 56). Gears 54, 56) are rotatably driven by the motor 52. A pair of opposing front guide gears 56 and a pair of opposing upper guide gears 58, (only the right side gears are shown), guide a pair of opposing tracks (60, 62) which are driven by the drive gears (54, 56). In a preferred embodiment the tracks (60, 62) are fabricated from a stainless steel chain having rubber cord screwed into the chain extensions.

Mounted adjacent to the nozzle 46 on the housing 50 is a video camera housing 64 which houses and protects a video camera. In a preferred embodiment, a low light black and white or color camera is used which is equipped with a wide angle lens. Video signals and electric current are supplied to the tractor assembly 48 via an electric conduit 66 (FIG. 1). A six wire swivel is preferably connected between the wires within the conduit 66 in order to prevent the conduit 66 and the wires it houses from twisting as the conduit 66 is reeled on and from the reel assembly 22. Swivels of this type may be purchased from Litton Poly Scientific (part CA-4023-6), Blacksburg, Va.

The video signals from the camera may be viewed on a conventional video monitor 68 and recorded and played back by a conventional video recorder/player 70 (FIG. 1).

The velocity and direction of the tractor assembly 48 and the video camera may be controlled via the control panel 72 (FIG. 1). Camera and remote vehicle control are well known and are not discussed herein.

Figure 2:
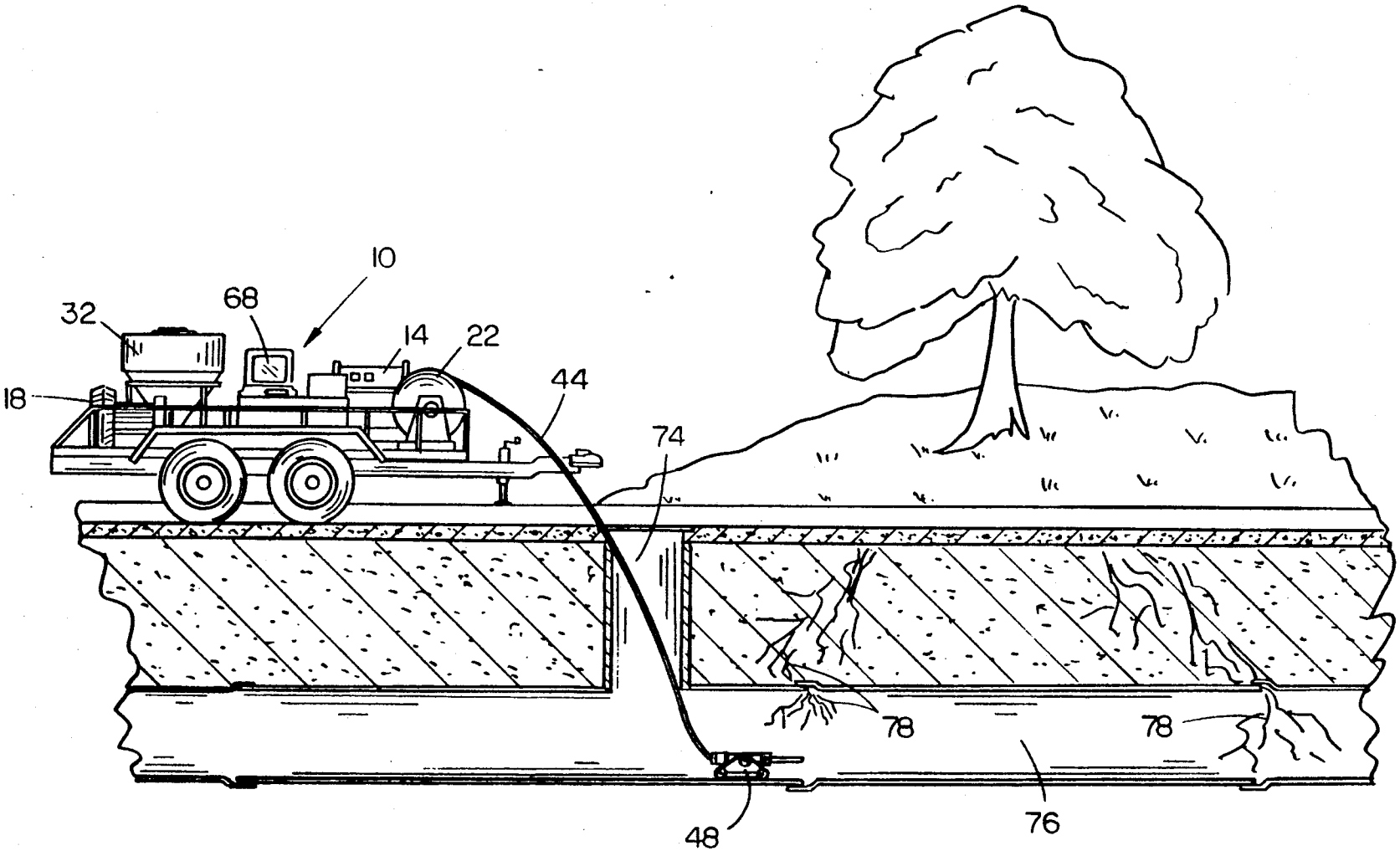
FIG. 2 is a cross-sectional side elevational view of a preferred embodiment of the apparatus for applying dry herbicides to sewer lines showing the apparatus in use.

In operation, the tractor assembly 48 is lowered into a sewer line 76 from a manhole 74. The video camera is turned on and the tractor assembly is driven within the sewer line 76 until a flora infestation 78 is encountered (FIGS. 2 & 3). Herbicide is then sprayed from the nozzle 46 directly on an infestation 78. In a preferred embodiment the herbicide is a mixture containing Dichlobenil (2,6-dichlorobenzonitrile).

While the invention has been described with a certain degree of particularity, it is manifest that many changes may be made in the details of construction and the arrangement of components without departing from the spirit and scope of the disclosure. For example, a light source may be provided for illuminating the interior of the sewer line. It is understood that the invention is not limited to the embodiments set forth herein for purposes of exemplification, but is to be limited only by the scope of the appended claims including the full range of equivalency to which each element thereof is entitled.

Thus, there has been shown and described an improved apparatus for applying herbicides to sewer lines which accomplishes at least all of the stated objects.

I claim:

1. An apparatus for applying dry herbicides to sewer line interiors, comprising:

(a) a container for storing a dry herbicide;

(b) a length of water and gas impervious tubing;

(c) nozzle means connected to said tubing;

(d) means for pneumatically propelling herbicide stored in said container through said tubing such that the herbicide is dispersed from said nozzle;

(e) locomotion means for carrying said tubing and said nozzle within the interior of a sewer line such that the interior surfaces of a sewer line may be sprayed with herbicide whereby any flora growing within the sewer line collects a herbicidally effective amount of herbicide thereby inhibiting the growth of any flora within the sewer line.

2. The apparatus for applying dry herbicides to sewer line interiors of claim 1, wherein said pneumatically propelling means comprises:

an electric generator;

a ring compressor with motor;

a rotary airlock and drive.

3. The apparatus for applying dry herbicides to sewer line interiors of claim 2, wherein said locomotion means comprises:

a self-contained tractor assembly powered by an internal, reversible motor.

4. The apparatus for applying dry herbicides to sewer line interiors of claim 2, further comprising:

(f) a video camera attached to said tractor assembly for obtaining video images of the interior of a sewer line; and (g) a video monitor for viewing said video images whereby an operator may selectively direct herbicide application only to flora infested areas.

5. The apparatus for applying dry herbicides to sewer line interiors of claim 2, further comprising:

(h) control means for said pneumatically propelling means whereby the flow rate of herbicide dispensing may be controlled.

* * * * *